US006543554B2

(12) United States Patent
Smith

(10) Patent No.: US 6,543,554 B2
(45) Date of Patent: Apr. 8, 2003

(54) ADJUSTABLE HOUSING FOR A MUD MOTOR

(75) Inventor: Winston Smith, Edmonton (CA)

(73) Assignee: Continental Directional Corp., Nisku (CA)

( * ) Notice: Subject to any disclaimer, the term of this patent is extended or adjusted under 35 U.S.C. 154(b) by 0 days.

(21) Appl. No.: 09/860,604

(22) Filed: May 21, 2001

(65) Prior Publication Data

US 2002/0170751 A1 Nov. 21, 2002

(51) Int. Cl.[7] ..... E21B 7/08

(52) U.S. Cl. ..... 175/74; 175/107; 175/256; 175/320

(58) Field of Search ..... 175/73, 74, 107, 175/256, 320

(56) References Cited

U.S. PATENT DOCUMENTS 4,877,092 A * 10/1989 Helm et al.
5,048,621 A 9/1991 Bailey et al.
5,101,914 A * 4/1992 Wenzel
5,269,385 A * 12/1993 Sihlis

* cited by examiner

*Primary Examiner*—Roger Schoeppel
(74) *Attorney, Agent, or Firm*—Thomas E. Malyszko

(57) ABSTRACT

There is provided an adjustable housing for use with a drill string for controlled directional drilling of a well hole. The housing includes an upper sub and a lower sub each having a first portion extending along a primary axis and a second portion extending along a secondary axis offset from the primary axis by a predetermined angle. The second portions are rotatably mounted together such that the secondary axes of the respective upper and lower subs are coincident. The upper sub is thus rotatable in relation to the lower sub between a bent position wherein the primary axes of the upper and lower subs are misaligned and a parallel position wherein the primary axes of the upper and lower subs are parallel to each other. A locking member is slidably mounted on splines extending radially from the second portion of the upper sub such that the locking member is slidable between an engaged position and disengaged position. In the engaged position the locking member engages teeth on the lower sub such that the upper sub cannot rotate relative to the lower sub. In the disengaged position each sub is rotatable in relation to the other.

15 Claims, 3 Drawing Sheets

ADJUSTABLE HOUSING FOR A MUD MOTOR

FIELD OF THE INVENTION

This invention relates to an adjustable housing for a mud motor and more particularly to an adjustable housing for directional drilling of well bores.

BACKGROUND

U.S. Pat. No. 5,048,621 to Bailey et al provides an adjustable bent housing for controlled directional drilling of well bores. The bent housing comprises a first sub rotatably mounted to a second sub for adjustment of an angle therebetween. An end portion of the outer surface of the first sub and an end portion of the inner surface of the second sub have annular offsets from the central axes of the subs to allow angular adjustment when one sub is rotated relative to the other. Once the desired angle has been set, rotation of the first sub relative to the second sub is prevented by an adjusting ring which includes both internal and external splines for engaging splines on both first and second subs. The adjusting ring however is axially aligned with the first sub and thus engages the spines on the second sub at the offset angle. The adjusting ring therefore is not evenly secured across its entire end face to the second sub. Machining the complex spline structure and the surfaces at an offset angle is a costly and difficult procedure.

SUMMARY

According to the present invention there is provided an adjustable housing for use with a mud motor, the adjustable housing comprising:

an upper sub comprising a top portion having a primary longitudinal axis, a bottom portion having a secondary longitudinal axis offset from the primary longitudinal axis by a first predetermined angle and a first set of splines extending axially along an outer surface of the bottom portion, a lower sub comprising a lower portion having a primary longitudinal axis, a top portion having a secondary longitudinal axis offset from the primary longitudinal axis by a second predetermined angle and an engaging face on a top end of the top portion perpendicular to the secondary axis of the lower sub;

mounting means rotatably mounting the bottom portion of the upper sub on the top portion of the lower sub such that the secondary axes are coincident and the upper sub is rotatable relative to the lower sub;

an annular locking member mounted coaxially on the bottom portion of the upper sub, the locking member having a second set of splines extending axially along an inner surface of the locking member and engaging the first set of splines for sliding movement on the bottom portion of the upper sub between an engaged position wherein an end of the locking member engages the engaging face to prevent rotation of the upper sub relative to the lower sub and a disengaged position wherein the locking member does not engage the engaging face such that the upper sub is free to rotate relative to the lower sub; and lock securing means for securing the locking member in the engaged position.

The advantage of this arrangement is that the locking member and a portion of each sub are all coaxial for rotation about the same axis. The locking member engages an end engaging face that is perpendicular to that axis and not offset.

Preferably there is provided a first set of teeth on the end of the locking member and a second set of teeth on the engaging face of the lower sub, the first and second sets of teeth being arranged to engage each other for locking the subs together in the engaged position, regardless of the relative orientation of the two subs.

For mounting the adjustable housing in line with a drill string there is preferably provided a threaded section on a top end of the upper sub and a threaded section on a bottom end of the lower sub.

The lower portion of the upper sub preferably has a reduced diameter for being received coaxially within the upper portion of the lower sub.

The mounting means may comprise a threaded section having an annular groove at an end thereof for allowing longitudinal displacement of the upper sub relative to the lower sub as the upper sub is rotated relative to the lower sub.

Preferably there is provided at least one annular seal mounted about an outer face of the bottom portion of the upper sub, the seal being arranged to engage an inner face of the top portion of the lower sub for sealing between the subs.

The lock securing means may comprise a locking nut threadably mounted coaxially on the lower portion of the upper sub above the annular locking member for engaging a top end of the annular locking member.

The first and second predetermined angles may be approximately equal such that the upper sub may be rotated relative to the lower sub into a parallel position wherein the primary longitudinal axes of the respective upper and lower subs are substantially parallel.

BRIEF DESCRIPTION OF THE DRAWINGS

In the accompanying drawings, which illustrate an exemplary embodiment of the present invention.

DETAILED DESCRIPTION

Figure 2:
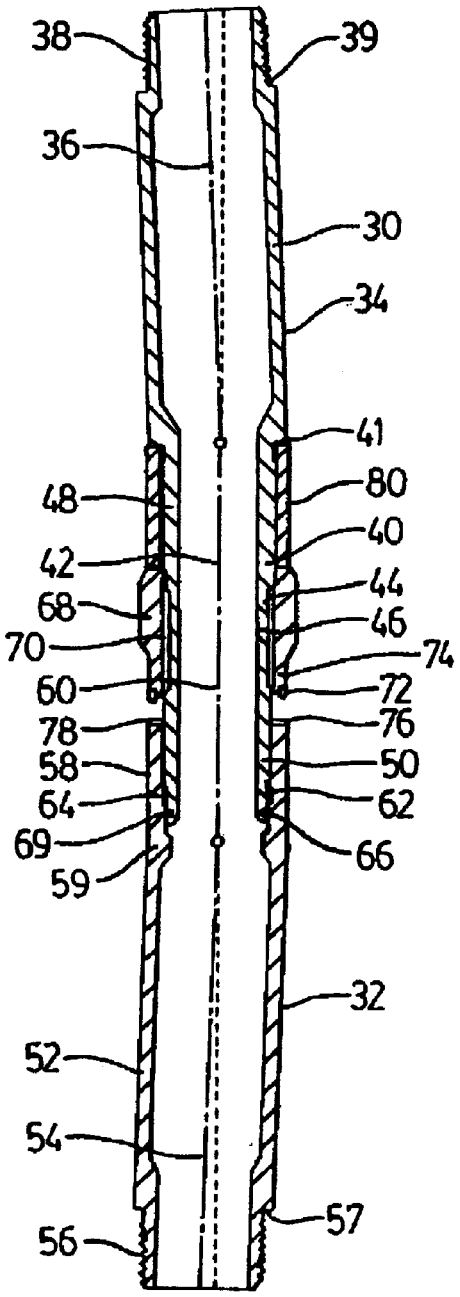
FIG. 2 is a vertical cross sectional view of the adjustable housing in a bent position with the locking member disengaged.
Figure 3:
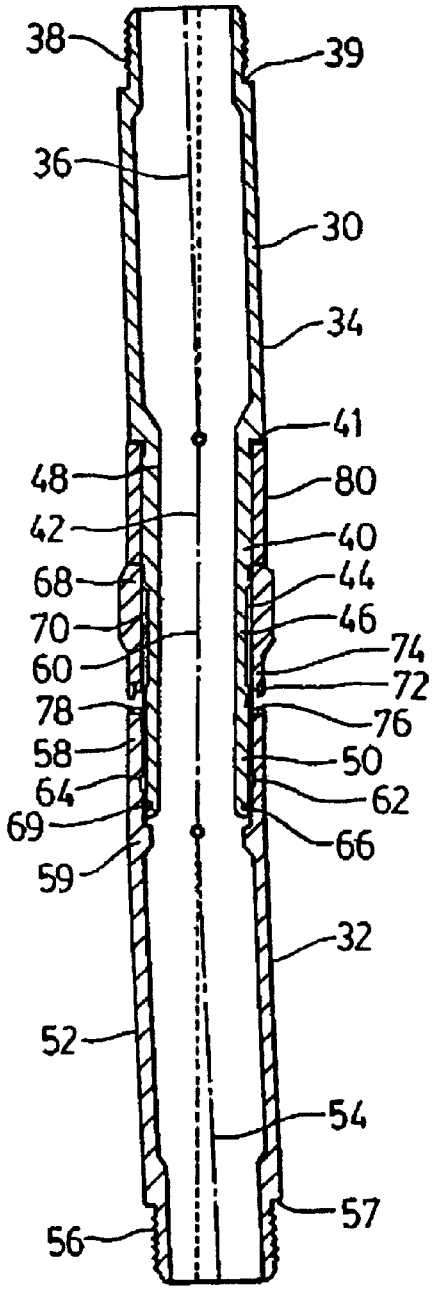
FIG. 3 is a vertical cross sectional view of the adjustable housing in a parallel position with the locking member disengaged.
Figure 4:
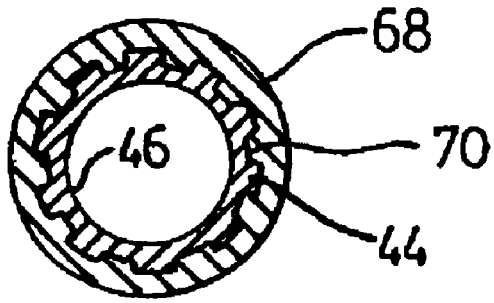
FIG. 4 is a cross sectional view of the adjustable housing along the line 4—4 of FIG. 1.
Figure 5:
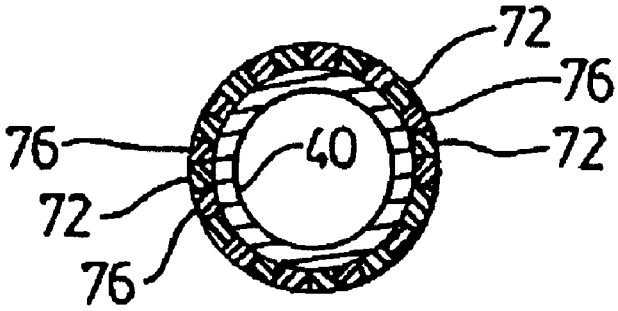
FIG. 5 is a cross sectional view of the adjustable housing along the line 5—5 of FIG. 1.

Referring to the accompanying drawings, there is illustrated an adjustable housing generally indicated by the reference numeral 10. The adjustable housing 10 is adjustable between a bent position as shown in FIG. 2 and a parallel position as shown in FIG. 3 such that the adjustable bent housing may be used with a drill string 12 for controlled directional drilling.

Figure 1:
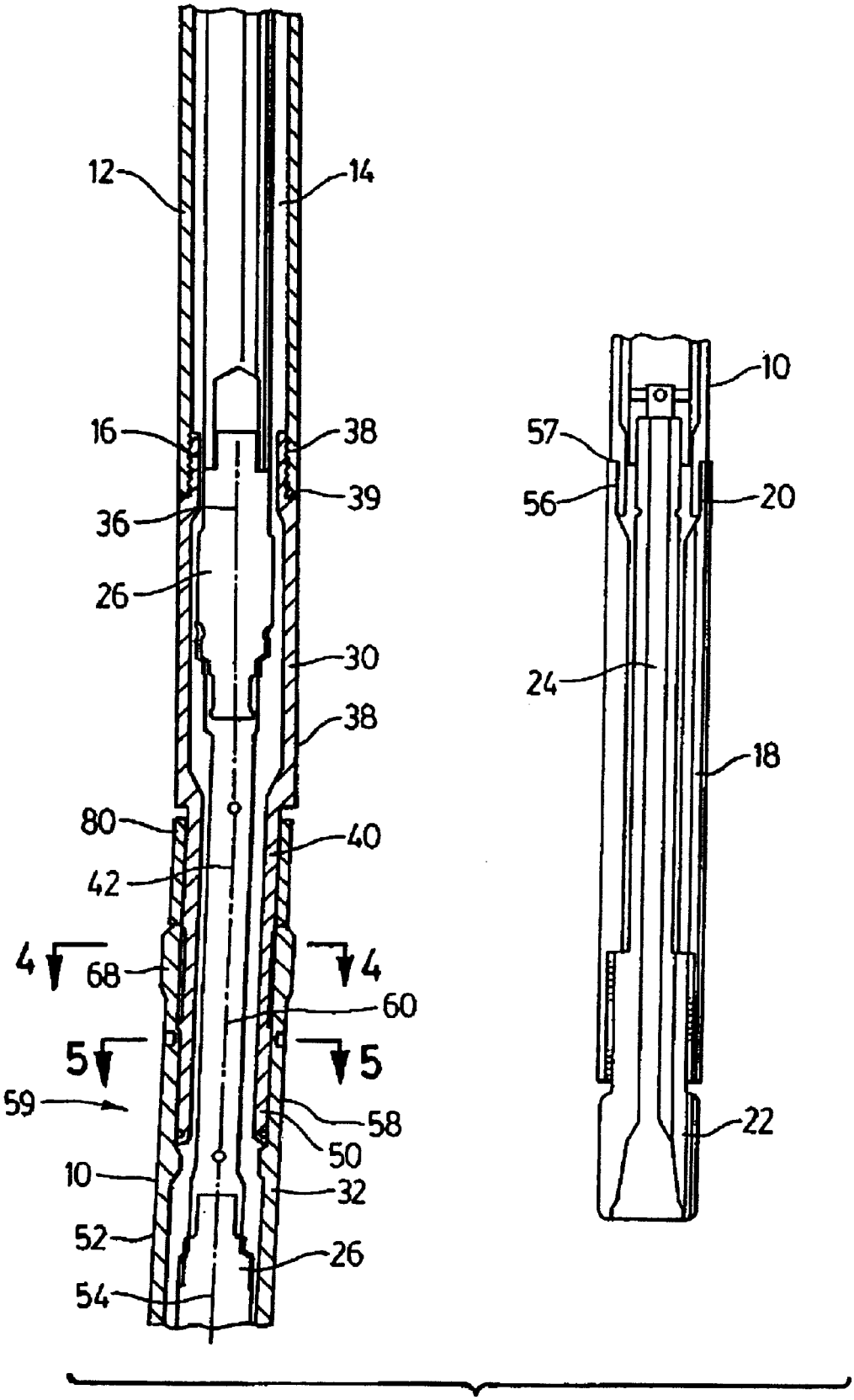
FIG. 1 is a vertical cross-sectional view of the adjustable housing connected in line with a drill string showing the adjustable housing in a bent position with the locking member engaged.

Referring to FIG. 1, the drill string 12 includes a mud motor 14 threadably connected at a top end 16 of the adjustable housing and a bearing section 18 threadably connected at a bottom end 20 of the adjustable housing. The bearing section 18 rotatably supports a bit box 22 used for mounting a drill bit therein. A drive shaft 24 extends through the drill string. The drive shaft 24 connects between the mud motor 14 and the bit box 22. A pair of constant velocity joints 26 are mounted on the drive shaft 24 near respective top and bottom ends of the adjustable housing to accommodate the bend in the housing.

The adjustable housing 10 includes an upper sub 30 and a lower sub 32. The upper sub 30 includes a first upper cylindrical portion 34 having a primary upper longitudinal axis 36. A threaded section 38 of reduced diameter extends axially from a top end 39 of the first upper cylindrical portion 34 and includes threads on an external surface for connecting to the drill string 12.

A second upper cylindrical portion 40 of reduced diameter extends from a bottom end 41 of the first upper cylindrical portion 34 along a secondary upper longitudinal axis 42 The secondary upper longitudinal axis 42 is offset from the primary upper longitudinal axis by a predetermined angle. A first set of splines 44 extends radially outward and axially along an outer face of the sub from a splined section 46 of the second upper cylindrical portion 40. A threaded section 48 of the second upper cylindrical portion 40 above the splined section 46 includes threads on external surface thereof. The second upper cylindrical portion 40 includes an externally threaded mounting section 50 below the splined section 46 for mounting the lower sub 32 thereon.

The lower sub 32 includes a first lower cylindrical portion 52 having a primary lower longitudinal axis 54. A threaded section 56 of reduced diameter extends axially from a bottom end 57 of the first lower cylindrical portion 52 and includes threads on an external surface for connecting to the drill string 12.

A second lower cylindrical portion 58 extends from a top end 59 of the first lower cylindrical portion 52 along a secondary lower longitudinal axis 60. The secondary lower longitudinal axis 60 is offset from the primary lower longitudinal axis by the same predetermined angle as the primary and secondary upper longitudinal axes 36 and 42 of the upper sub 30. The second lower cylindrical portion 58 is internally threaded to receive the mounting section 50 of the second upper cylindrical portion 40 therein such that the secondary upper and lower longitudinal axes 42 and 60 are coincident.

A ring seal 69 is located around an inner face 66 of the second lower cylindrical portion 58 and is received in an annular groove in the upper sub for sealing between the upper and lower subs. A thread relief 64 is located in the inner face 66 of the second lower cylindrical portion 58 for receiving a bottom end of the external threads of the mounting section 50 as the mounting section is displaced longitudinally relative to the lower sub during rotation of the upper sub in relation to the lower sub.

The upper sub 30 is thus rotatable relative to the lower sub 32 between the bent position of FIG. 2 and the parallel position of FIG. 3. In the bent position, the upper and lower primary longitudinal axes 36 and 54 are offset from each other such that the adjustable housing 10 may be used for directional drilling. In the parallel position, the upper and lower primary longitudinal axes 36 and 54 are parallel to each other for drilling straight.

A locking member 68 is mounted coaxially on the splined section of the second upper cylindrical portion 40. The locking member 68 is in the form of a collar having a second set of splines 70 extending radially inwards and axially along an inner face of the locking member. The second set of splines 70 is arranged to engage the first set of splines such that the locking member 68 is slidable in an axial direction along the second upper cylindrical portion and cannot rotate relative to the second upper cylindrical portion.

A first set of teeth 72 are mounted around a periphery of a bottom end 74 of the locking member and extend downwards for engaging the lower sub 32. The bottom end 74 of the locking member is perpendicular to the secondary axis 60 extending therethrough. A second set of teeth 76 are mounted around a periphery of the second lower cylindrical portion 58 and extend upwards from a top end 78 for engaging the first set of teeth 72. The top end 78 is perpendicular to the secondary axis 60 extending therethrough.

The locking member 68 is thus slidable between an engaged position as shown in FIG. 1 and a disengaged position as shown in FIG. 2. In the engaged position the locking member is adjacent the lower sub such that the first and second sets of teeth 72 and 76 are engaged and the upper sub cannot rotate in relation to the lower sub. Sliding the locking member upwards will move it into the disengaged position spaced from the lower sub such that the first and second sets of teeth 72 and 76 are disengaged and the upper sub is rotatable in relation to the lower sub. Rotation of the upper sub in relation to the lower sub will set the offset angle between the primary upper and lower longitudinal axes.

A locking nut 80 is mounted coaxially on the threaded section 48 of the second upper cylindrical portion 40 such that internal threads on the locking nut mate with the external threads on the threaded section. The locking nut 80 is thus rotatable about the secondary upper longitudinal axis between the engaged position and the disengaged position. In the engaged position the locking nut 80 is adjacent the locking member 68 for securing the locking member against the lower sub such that the first and second sets of teeth are engaged against each other. Rotation of the locking nut 80 in a given direction will raise the nut into the disengaged position. In the disengaged position the locking nut is adjacent the first upper cylindrical portion 34 such that the locking member 68 is free to slide upwards also.

In use the adjustable housing 10 is connected in line with the drill string 12 as shown in FIG. 1. If directional drilling is desired the offset angle between the primary upper and lower longitudinal axes 36 and 54 is determined and set before the adjustable housing is placed in the well hole.

To set the offset angle between the upper and lower subs, the locking nut is unscrewed such that it is raised into the disengaged position so that the locking member may be slid upwards into the disengaged position as well. The upper sub is thus rotatable about the lower sub such that the offset angle is adjustable at any angle between the minimum when the adjustable housing is in the parallel position and a maximum when the upper sub is rotated 180 degrees from the parallel position in relation to the lower sub. The locking member and locking nut may then be secured in the engaged position such that the adjustable housing may be used in the well hole for directional drilling.

The locking member and locking nut are coaxially mounted with the subs such that the locking member engages the sub across its entire end face in the engaged position regardless of the orientation of the two subs.

With the adjustable housing in the bent position the drill string will drill into the ground at a slight bend. If straight drilling is desired while the adjustable housing is in the bent position, the drill string may be rotated to compensate for bend.

In an alternative arrangement the predetermined angle of offset between the primary and secondary upper longitudinal axes can be different than the predetermined angle of offset between the primary and secondary lower longitudinal axes. For example, an upper offset angle of the upper longitudinal axes may be approximately one degree, while a lower offset angle of the lower longitudinal ages may be approximately two degrees. In this instance the bend in the drill string may be varied from one degree, corresponding to the difference between the upper and lower offset angles, to three degrees, corresponding to the sum of the upper and lower offset angles, as the upper and lower subs are rotated in relation to each other.

While one embodiment of the present invention has been described in the foregoing, it is to be understood that other embodiments are possible within the scope of the invention. The invention is to be considered limited solely by the scope of the appended claims.

What is claimed is:

1. An adjustable housing for use with a mud motor, the adjustable housing comprising:

an upper sub comprising a top portion having a primary longitudinal axis, a bottom portion having a secondary longitudinal axis offset from the primary longitudinal axis by a first predetermined angle, and a first set of splines extending axially along an outer surface of the bottom portion;

a lower sub comprising a lower portion having a primary longitudinal axis, a top portion having a secondary longitudinal axis offset from the primary longitudinal axis by a second predetermined angle, and an engaging face on a top end of the top portion;

mounting means rotatably mounting the bottom portion of the upper sub on the top portion of the lower sub such that the secondary axes are coincident along the bottom portion of the upper sub and the upper sub is rotatable relative to the lower sub;

an annular locking member mounted coaxially to the coincident secondary axes on the bottom portion of the upper sub, the locking member having a second set of splines extending axially along an inner surface of the locking member and engaging the first set of splines coaxially for sliding movement on the bottom portion of the upper sub between an engaged position wherein an end of the locking member engages the engaging face uniformly regardless of the relative orientation of the upper and lower subs to prevent rotation of the upper sub relative to the lower sub and a disengaged position wherein the locking member does not engage the engaging face such that the upper sub is free to rotate relative to the lower sub; and lock securing means for securing the locking member in the engaged position.

2. The adjustable housing of claim 1 wherein there is provided a first set of teeth on the end of the locking member and a second set of teeth on the engaging face of the lower sub, the first and second sets of teeth being arranged to engage each other for locking the subs together in the engaged position, regardless of the relative orientation of the upper and lower subs.

3. The adjustable housing of claim 1 wherein there is provided a threaded section on a top end of the upper sub for connection to a drill string.

4. The adjustable housing of claim 1 where there is provided a threaded section on a bottom end of the lower sub for connection to a drill string.

5. The adjustable housing of claim 1 wherein the bottom portion of the upper sub has a reduced diameter for being received coaxially within the upper portion of the lower sub.

6. The adjustable housing of claim 5 wherein the mounting means comprises a threaded section having an annular groove at an end thereof for allowing longitudinal displacement of the upper sub relative to the lower sub as the upper sub is rotated relative to the lower sub.

7. The adjustable housing of claim 5 wherein there is provided at least one annular seal mounted about an outer face of the bottom portion of the upper sub, the seal being arranged to engage an inner face of the top portion of the lower sub for sealing between the subs.

8. The adjustable housing of claim 1 wherein the lock securing means comprises a locking nut threadably mounted coaxially to the coincident secondary axes on the bottom portion of the upper sub above the annular locking member for uniformly engaging a top end of the annular locking member.

9. The adjustable housing of claim 1 wherein the first and second predetermined angles are approximately equal such that the upper sub may be rotated relative to the lower sub into a parallel position wherein the primary longitudinal axes of the respective upper and lower subs are substantially parallel.

10. An adjustable housing for use with a mud motor comprising:

an upper sub comprising a top portion having a primary longitudinal axis, a bottom portion having a secondary longitudinal axis offset from the primary longitudinal axis by a first predetermined angle;

a lower sub comprising a lower portion having a primary longitudinal axis, an upper portion having a secondary longitudinal axis offset from the primary longitudinal axis by a second predetermined angle, the upper portion rotatably engaging the bottom portion to define an area along the housing where the secondary axes are coincident;

an annular locking member mounted coaxially to said bottom portion along said area of coincident secondary axes for sliding movement therealong between an engaged position with said lower sub to rotationally fix said upper sub thereto wherein said locking member uniformly engages said lower sub regardless of the relative orientation of said upper and lower subs, and a disengaged position wherein said locking member disengages said lower sub such that said upper sub is free to rotate relative to said lower sub; and securing means for securing said locking member in said engaged position.

11. The adjustable housing of claim 10 wherein said securing means comprises a locking nut threadably mounted coaxially to said bottom portion of said upper sub along said area of coincident axes for uniformly engaging a top end of said annular locking member.

12. The adjustable housing of claim 11 wherein there is provided a first set of teeth on an end of the locking member and a second set of teeth on a top end of the upper portion of the lower sub, the first and second sets of teeth being arranged to engage each other for locking the subs together in the engaged position, regardless of the relative orientation of the upper and lower subs.

13. The adjustable housing of claim 12 wherein the first and second predetermined angles are approximately equal such that the upper sub may be rotated relative to the lower sub into a parallel position wherein the primary longitudinal axes of the respective upper and lower subs are substantially parallel.

14. The adjustable housing of claim 13 wherein the bottom portion of the upper sub has a reduced diameter for being received coaxially within the upper portion of the lower sub.

15. The adjustable housing of claim 14 wherein there is provided at least one annular seal mounted about an outer face of the bottom portion of the upper sub, the seal being arranged to engage an inner face of the top portion of the lower sub for sealing between the subs.

* * * * *